US006676097B2

(12) United States Patent
Chu

(10) Patent No.: US 6,676,097 B2
(45) Date of Patent: Jan. 13, 2004

(54) DECORATIVE BOW BASE ADAPTED TO BE SECURELY ATTACHED TO A GIFT WRAPPING

(76) Inventor: Chih-Kang Chu, 8F, No. 81, Tung-Pei Street, Taipei City (TW)

( * ) Notice: Subject to any disclaimer, the term of this patent is extended or adjusted under 35 U.S.C. 154(b) by 0 days.

(21) Appl. No.: 10/157,148

(22) Filed: May 30, 2002

(65) Prior Publication Data

US 2003/0224126 A1 Dec. 4, 2003

(51) Int. Cl.[7] ..... A47B 95/00; A47G 91/00; B65D 19/00

(52) U.S. Cl. ..... 248/346.01; 248/205.3; 248/206.5; 248/346.03

(58) Field of Search ..... 248/205.3, 205.4, 248/206.5, 346.03, 346.04, 346.11, 346.5, 314, 310, 346.01, 467; 211/71.01, 72, 73; 428/4, 5, 6; 229/87.19

(56) References Cited

U.S. PATENT DOCUMENTS 2,217,514 A * 10/1940 Henry ..... 220/628
2,368,838 A * 2/1945 James ..... 24/304
3,174,886 A * 3/1965 Miscovich ..... 156/72
3,239,178 A * 3/1966 Pompa ..... 248/205.3
3,524,614 A * 8/1970 Sorth ..... 248/131
4,287,676 A * 9/1981 Weinhaus ..... 40/661.01
4,527,719 A * 7/1985 Mackrill ..... 223/44
5,308,671 A * 5/1994 Wells ..... 428/99
5,628,846 A * 5/1997 Huss et al. ..... 156/70
5,641,140 A * 6/1997 Sorenson ..... 248/205.3
6,216,279 B1 * 4/2001 Ellingson ..... 2/239
6,305,656 B1 * 10/2001 Wemyss ..... 248/309.4

* cited by examiner

*Primary Examiner*—Ramon O. Ramirez
*Assistant Examiner*—Amy J. Sterling
(74) *Attorney, Agent, or Firm*—Dennison, Schultz & Dougherty

(57) ABSTRACT

A decorative bow base includes a substrate having a chamber defined therein, an attachment device received in the chamber, an engaging face formed on top of the chamber and an adhesive element securely attached to a bottom of the substrate. A support has a space defined to adapt to securely receive therein a decorative bow, a bottom face formed on a bottom of the support to be securely engaged with the engaging face of the substrate.

1 Claim, 5 Drawing Sheets

DECORATIVE BOW BASE ADAPTED TO BE SECURELY ATTACHED TO A GIFT WRAPPING

BACKGROUND OF THE INVENTION

1. Field of the Invention

The present invention relates to a decorative bow base, and more particularly to a base that can receive therein decorative bow and then securely attached to a face of a gift-wrapping. The base has an attachment device received therein so that when the decorative bow is removed from the gift package, the decorative bow can be attached to a surface via the attachment device as an ornament.

2. Description of Related Art

The conventional base 7 for a decorative bow is shown in FIG. 1 and has a chamber 71 defined therein for receiving a decorative bow (not shown) and an extension 8 extending from a bottom of the base 7. When the base 7 is in use, the user places the decorative bow securely in the chamber 71 and then extends the extension 8 through a piece of paper or the like. After the extension is inserted through the piece of paper, the user melts the extension 8 so as to fasten the base 7 together with a decorative bow on the piece of paper. Then, an adhesive paper is attached to the piece of paper such that the user can use the adhesive paper to attach the base 7 together with the decorative bow onto a gift wrapping.

However, normally when people receive gift with a decorative bow attached on the gift wrapping, people remove the decorative bow from the gift wrapping be peeling off the adhesive paper. After the adhesive paper is removed, people either throw away the adhesive paper or detach the decorative bow from the base 7 so that the decorative bow can be reused for decoration. That is, the conventional base 7 is not able to be reused and has to be dealt with.

To overcome the shortcomings, the present invention intends to provide an improved decorative bow base to mitigate or obviate the aforementioned problems.

SUMMARY OF THE INVENTION

The primary objective of the invention is to provide a decorative bow base that can be reused so as to recycle the used material.

Another objective of the present invention is to provide a decorative bow base that has a substrate with an attachment device and a support engaged with a top face of the substrate. The attachment device can allow the base to be attached to a gift-wrapping and any appropriate surface once removed from the gift-wrapping.

Other objects, advantages and novel features of the invention will become more apparent from the following detailed description when taken in conjunction with the accompanying drawings.

DETAILED DESCRIPTION OF PREFERRED EMBODIMENT

Figure 1:
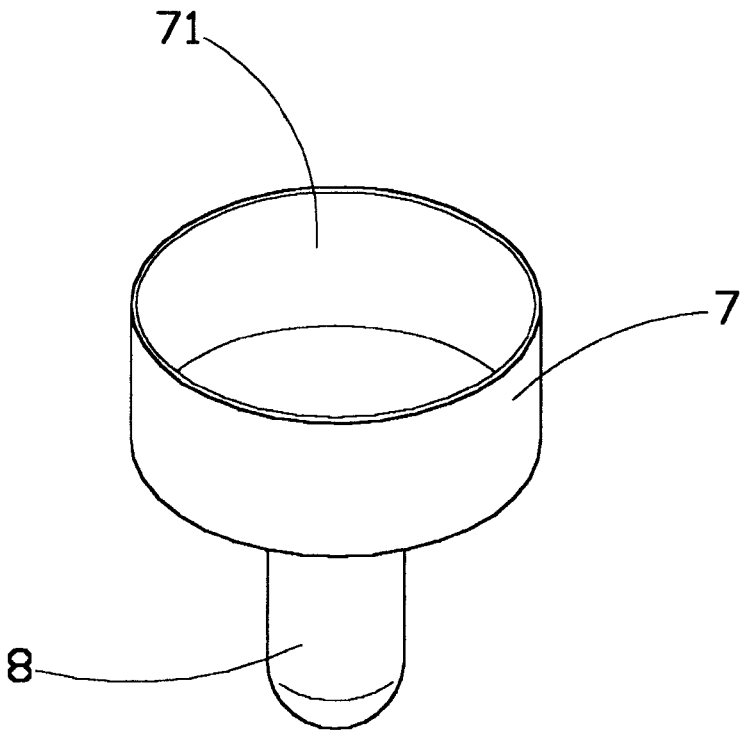
Fig. 1 (Prior Art)
FIG. 1 is a perspective view of a conventional base for receiving therein a decorative bow.
Figure 2:
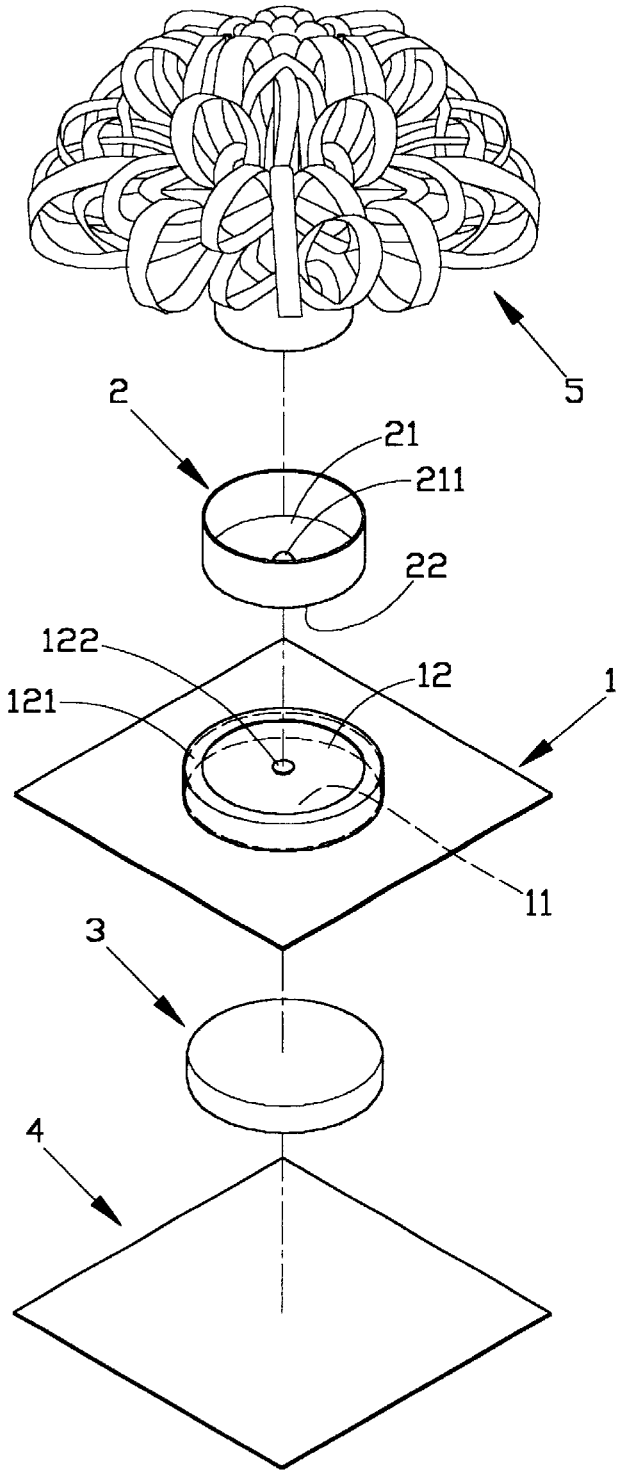
FIG. 2 is an exploded perspective view of the decorative bow base of the present invention.

With reference to FIG. 2, the decorative bow base of the present invention is composed of a substrate 1 with an attachment device 3 received inside the substrate 1 and a support 2 engaged with a top face of the substrate 1.

The substrate 1 has a chamber 11 defined to receive therein the attachment device 3 and an engaging face 12 formed on top of the chamber 11 so as to cover the chamber 11. The engaging face 12 has an annular flange 121 formed on an outer peripheral edge of the engaging face 12 and a centrally defined recess 122. In this preferred embodiment, the attachment device 3 is a magnet.

The support 2 has a closed end and an open end so that a space 21 is defined in the support 2. The support 2 further has a boss 211 formed on a bottom face 22 defining the space 21 to correspond to the recess 122 of the substrate 1. It is to be noted that an adhesive element 4 is provided under the substrate 1.

Figure 3:
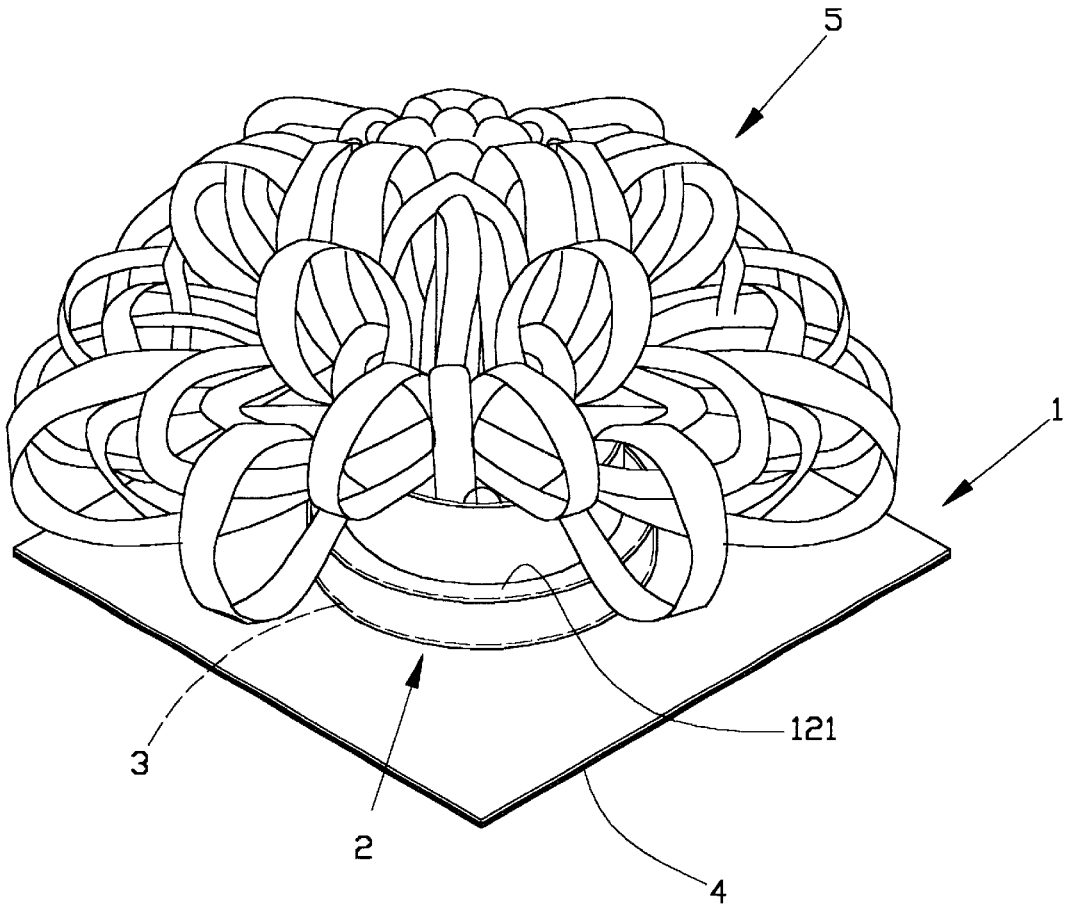
FIG. 3 is a perspective view showing the assembled decorative bow base.
Figure 4:
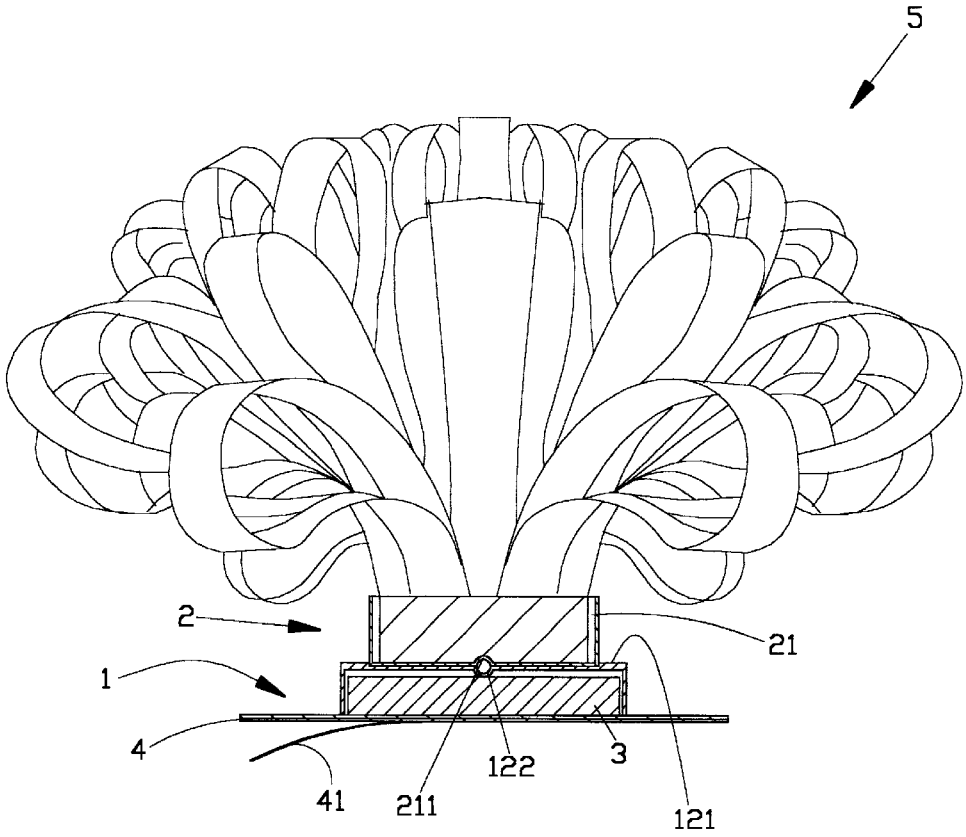
FIG. 4 is a cross sectional view of the decorative bow base in FIG. 3.
Figure 5:
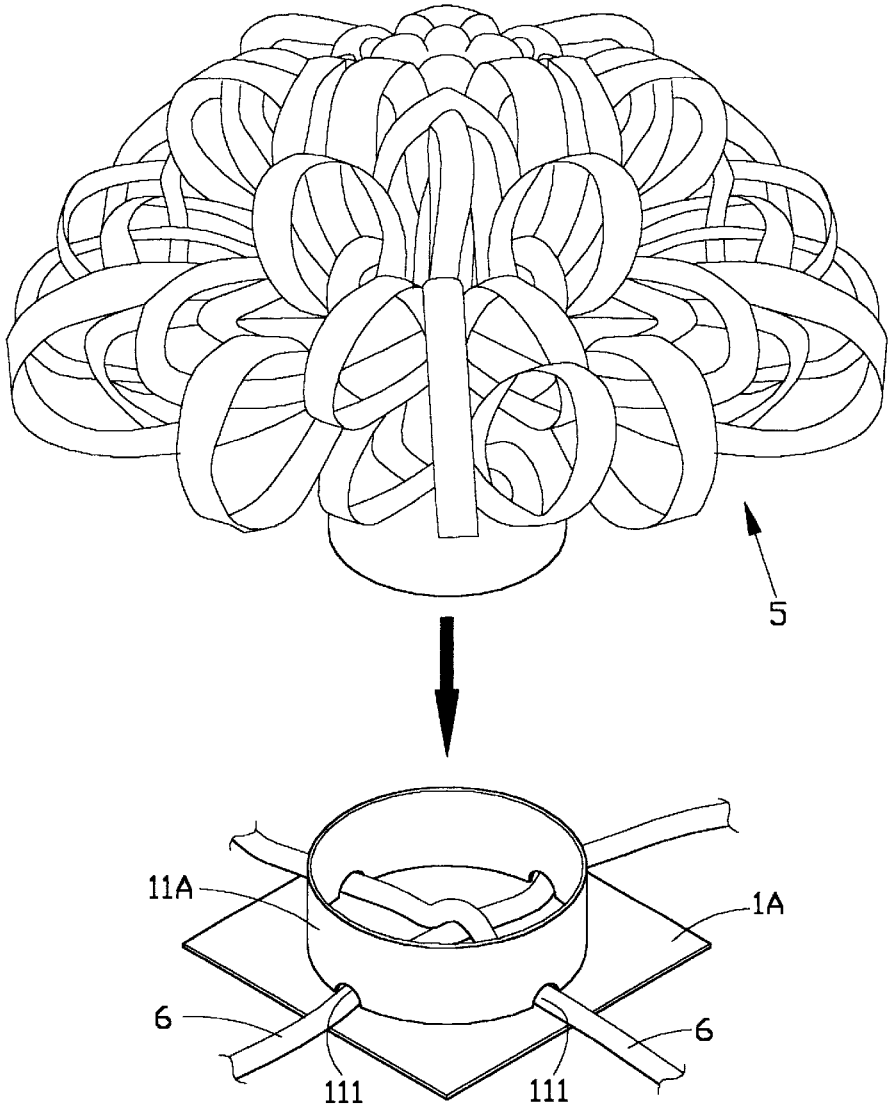
FIG. 5 is a perspective view of another embodiment of the decorative bow base of the present invention.

With reference to FIGS. 3 and 4, when the decorative bow base is to be assembled, the attachment device 3 is received in the chamber 11 and then the adhesive element 4 is attached to the bottom of the substrate 1. After the assembly of the substrate 1 is completed, the recess 122 is filled with glue so that when the support 2 is placed on top of the engaging face 12 with the boss 211 aligned with the recess 122, the support 2 can be securely engaged with the substrate 1. It is noted that the inner diameter of the annular flange 121 is slightly larger than the diameter of the outer diameter of the bottom face 22 of the support 2 so that the support 2 can be snugly received in the area enclosed by the annular flange 121. When the foregoing assembly is finished, a decorative bow 5 is securely received in the space 21.

When the decorative bow base of the present invention is in use, the user only needs to peel off a releasing film 41 attached to one side of the adhesive element 4 to expose the adhesive layer (not numbered) so that the decorative bow base can be attached to a gift wrapping (not shown). When the decorative bow base is removed from the gift-wrapping and the strength of the adhesive layer of the adhesive element 4 is reduced, the user may still apply the decorative bow base to a metal surface due to the attachment device 3 received in the chamber 11 of the substrate 1.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A decorative bow base comprising:

a substrate having a top face, a bottom face, a chamber therein, an engaging face formed on top of said chamber and said engaging face defining a central recess therein;

a magnetic attachment device disposed in said chamber and an adhesive element securely attached to said bottom face of said substrate;

an annular support having a peripheral edge, an upwardly extending wall about said peripheral edge with a closed bottom face having an outer diameter, and an upwardly facing open end to thereby define a space for receiving a decorative bow, and a downwardly extending boss formed in said bottom face of said support; and said engaging face including an annular flange formed therein with an inner diameter of said annular flange slightly larger then said outer diameter of said bottom face of said annular support so that said support is snugly received in a space defined by said annular flange; and wherein said boss is aligned with said recess and glued therein whereby said support is securely fastened to said substrate.

* * * * *

UNITED STATES PATENT AND TRADEMARK OFFICE

CERTIFICATE OF CORRECTION

PATENT NO. : 6,676,097 B2
DATED : January 13, 2004
INVENTOR(S) : Chih-Kang Chu

It is certified that error appears in the above-identified patent and that said Letters Patent is hereby corrected as shown below:

Title page,
Item [76], Inventor, please change the inventors name as follows:
-- Jyh Gang Chu --

Signed and Sealed this

Eighteenth Day of January, 2005

JON W. DUDAS
*Director of the United States Patent and Trademark Office*